US009100999B2

(12) United States Patent
Li

(10) Patent No.: US 9,100,999 B2
(45) Date of Patent: Aug. 4, 2015

(54) SWIMMING POOL LED LIGHTING SYSTEM AND METHOD USING PROPRIETARY FREQUENCY-SHIFT KEYING OVER 2-WIRE POWER CORD

(71) Applicant: S.R. Smith, LLC, Canby, OR (US)

(72) Inventor: Chuan Li, Fremont, CA (US)

(73) Assignee: S.R. Smith, LLC, Canby, OR (US)

( * ) Notice: Subject to any disclaimer, the term of this patent is extended or adjusted under 35 U.S.C. 154(b) by 121 days.

(21) Appl. No.: 14/163,544

(22) Filed: Jan. 24, 2014

(65) Prior Publication Data

US 2014/0203710 A1 Jul. 24, 2014

Related U.S. Application Data

(60) Provisional application No. 61/756,285, filed on Jan. 24, 2013.

(51) Int. Cl.
*H05B 37/02* (2006.01)

(52) U.S. Cl.
CPC ..... *H05B 37/02* (2013.01)

(58) Field of Classification Search
CPC .. H05B 37/02; H05B 37/029; H05B 37/0245; H05B 37/0263; H05B 37/0272; F21W 2131/401; F21V 23/04; F21V 23/0471; F21V 23/003; F21Y 2101/02; F21S 10/002; Y10S 362/80; Y10S 362/806; Y10S 362/811
USPC ..... 315/291, 294, 307, 224, 312, 318, 320; 362/101, 231, 800, 811, 85
See application file for complete search history.

(56) References Cited

U.S. PATENT DOCUMENTS

| | | | | |
|---|---|---|---|---|
| 6,528,954 | B1 * | 3/2003 | Lys et al. | 315/291 |
| 7,358,929 | B2 * | 4/2008 | Mueller et al. | 345/1.3 |
| 8,519,566 | B2 * | 8/2013 | Recker et al. | 307/64 |
| 8,829,799 | B2 * | 9/2014 | Recker et al. | 315/160 |
| 2008/0197788 | A1 * | 8/2008 | Conover et al. | 315/291 |
| 2014/0265842 | A1 * | 9/2014 | Potucek et al. | 315/77 |

OTHER PUBLICATIONS

"Screenlogic Interface for Mobile Digital Devices", 2013, website : www.pentairpool.com.

"Use Ipad, Iphone or Ipod Touch to Control Your Pool", Jan. 24, 2013, website: www.pentairpool.com/pool-owner/news/product/iphone.htm.

'iAquaLink™, Jan. 24, 2013, website: www.zodiacpoolsystems.com/Products/Controls/iAquaLink.aspx.

Baumgartner, Mark, "Pool-Lights iPhone Control", Jan. 2013, website: http://vimeo.com/41043199.

* cited by examiner

*Primary Examiner* — Haiss Philogene

(57) ABSTRACT

A system for controlling a lamp comprises a central controller having a waveform converter capable of modulating a control signal at more than one frequency over a two wire power cable. The control signal is capable of modifying a property of the lamp. The central controller also has a load current sensor capable of identifying the configuration of the lamp. The system further comprises a lighting control unit coupled to the lamp. The lighting control unit is powered via the two wire power cable and is capable of demodulating the control signal.

15 Claims, 9 Drawing Sheets

SWIMMING POOL LED LIGHTING SYSTEM AND METHOD USING PROPRIETARY FREQUENCY-SHIFT KEYING OVER 2-WIRE POWER CORD

CROSS-REFERENCE TO RELATED APPLICATIONS

This application claims the benefit of U.S. Provisional Patent Application No. 61/756,285, filed on Jan. 24, 2013, the disclosure of which is incorporated by reference herein in its entirety.

FIELD OF THE INVENTION

The present invention relates to an electronics system for swimming pool LED lighting, in particular to the method using FSK (Frequency-Shift Keying) and specific protocol to simultaneously transfer the power and the control signals over existing widely-used 2-wire power cord. A load-current sensing technique is employed to identify two different types of the LED lights, "color or white", and a GUI (Graphic User Interface) on a computing device, such as a smart phone, may demonstrate the central controller's port connection status. The central controller may have two different bands, for example, at 915 MHz and 2.4 GHz Bluetooth, to communicate with the RF remote controller and the smart phone for lighting control. The LED lamps working with the central controller may demodulate the control signals from the carrier signal in terms of the predefined protocols.

BACKGROUND OF THE INVENTION

A product made by Australian Bellson Electric has 5 output ports for color LED lamp connection through a 4-wire power cord. This 4-wire cord is not compatible with the existing 2-wire power cord widely-used in the current swimming pool lighting industry. In the 4 wire cord, one wire is grounding, and the other 3 wires are used to convey PWM (Pulse Width Modulation) signals to drive red, green, or blue diode in the color lamp, separately. The Bellson product uses Wi-Fi in peer-to-peer mode to communicate between a smart phone and the controller. While the phone is connected to the controller, it implicitly switches the Wi-Fi connection from the home Wi-Fi router to the controller, causing the device to lose its Internet connection. Replacing the existing 2-wire cord with the new 4-wire power cord, in the ground, is usually a difficult and costly job. Furthermore, the controller works only with color LED lamps. Accordingly, there is a need for a solution to this problem that allows for both white and colored light, and which can work over the 2-wire power cords that are installed in countless pool systems across the country and around the world.

SUMMARY OF THE INVENTION

A swimming pool LED lighting system, consisting of a central controller, a RF remote controller, a Bluetooth-built-in smart phone, and specially-designed LED lamps. The central controller simultaneously transmits 12 Vrms power source in sinusoid waveform and the control signals modulated with F/2F to the lamps over the widely-used 2-wire power cord. The system is able to identify the type of LED lamps connected with the central controller by using a load-current sensing technique, so the lamp installation in field can be simplified.

DETAILED DESCRIPTION

In view of the shortcomings of the prior art, the embodiment of the present invention disclosed herein comprises a method of using FSK modulation/demodulation technique, especially F/2F (600 Hz representing binary '0' and 1200 Hz (2×600 Hz) standing for binary '2'), to simultaneously transmit 12 Vrms power source in sinusoid waveform and the lighting control signals from the central controller to the LED lamps over the 2-wire power cord existing in the current swimming pool lighting infrastructure.

In the first aspect of the present invention, a load-current sensing technique is employed to identify two different types of the LED lamps, "color or white", enabling the color and the white LED lamps ready for PnP (Plug and Play).

In the second aspect of the present invention, the central controller transmits the LED lamps configured status on its ports to the smart phone for the screen display.

In the third aspect of the present invention, the central controller uses the Bluetooth protocol to communicate to the smart phone with a built-in Bluetooth.

In the fourth aspect of the present invention, the RF remote is designed specifically in the form of the lighting control GUI for resembling the control operation as the smart phone.

In the fifth aspect of the present invention, a specific color or white LED lamp has a built-in circuit to demodulate the lighting control signals modulated with F/2F technique from the central controller.

In the final aspect of the present invention, a dry contact is made for an external relay to control the lamps.

Before embodiments of the invention are explained in detail, it is to be understood that the invention is not limited in its application to the details of the examples set forth in the following descriptions or illustrated drawings. The invention is capable of other embodiments and of being practiced or carried out for a variety of applications and in various ways. Also, it is to be understood that the phraseology and terminology used herein is for the purpose of description and should not be regarded as limiting.

Figure 1:
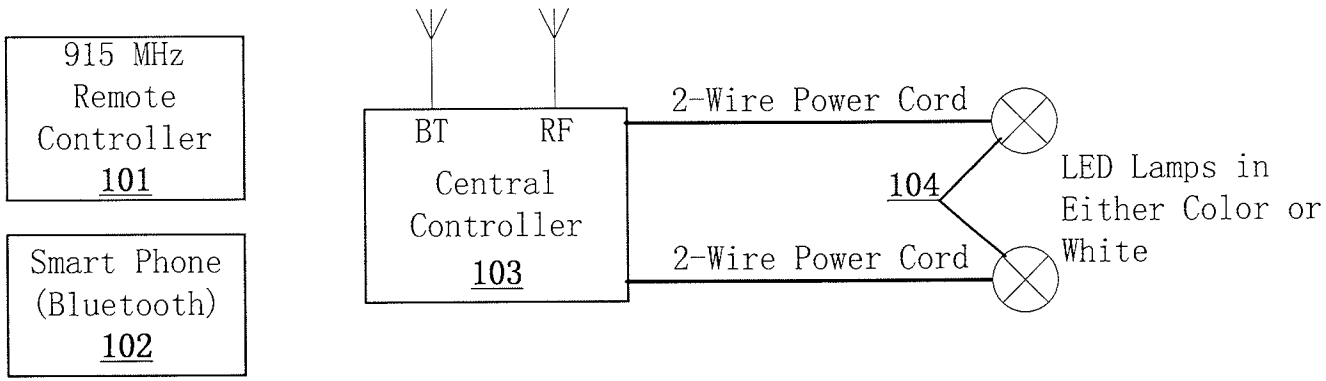
FIG. 1 is a system block diagram showing the entire system configuration.

As shown in FIG. 1, the entire system is comprised of a central controller 103, 2-wire power connection cords, specific LED lamps 104, and the manual controller—either a smart phone 102 or a RF remote controller 101. The central controller has two bi-directional wireless communications modules working in 2.4 GHz Bluetooth and 915 MHz bands, separately. The central controller has total 10 output ports 218 (FIG. 2 and FIG. 5) which can be connected to the LED lamps in color or white. Each port has maximum 8 Watts loading capability.

Figure 2:
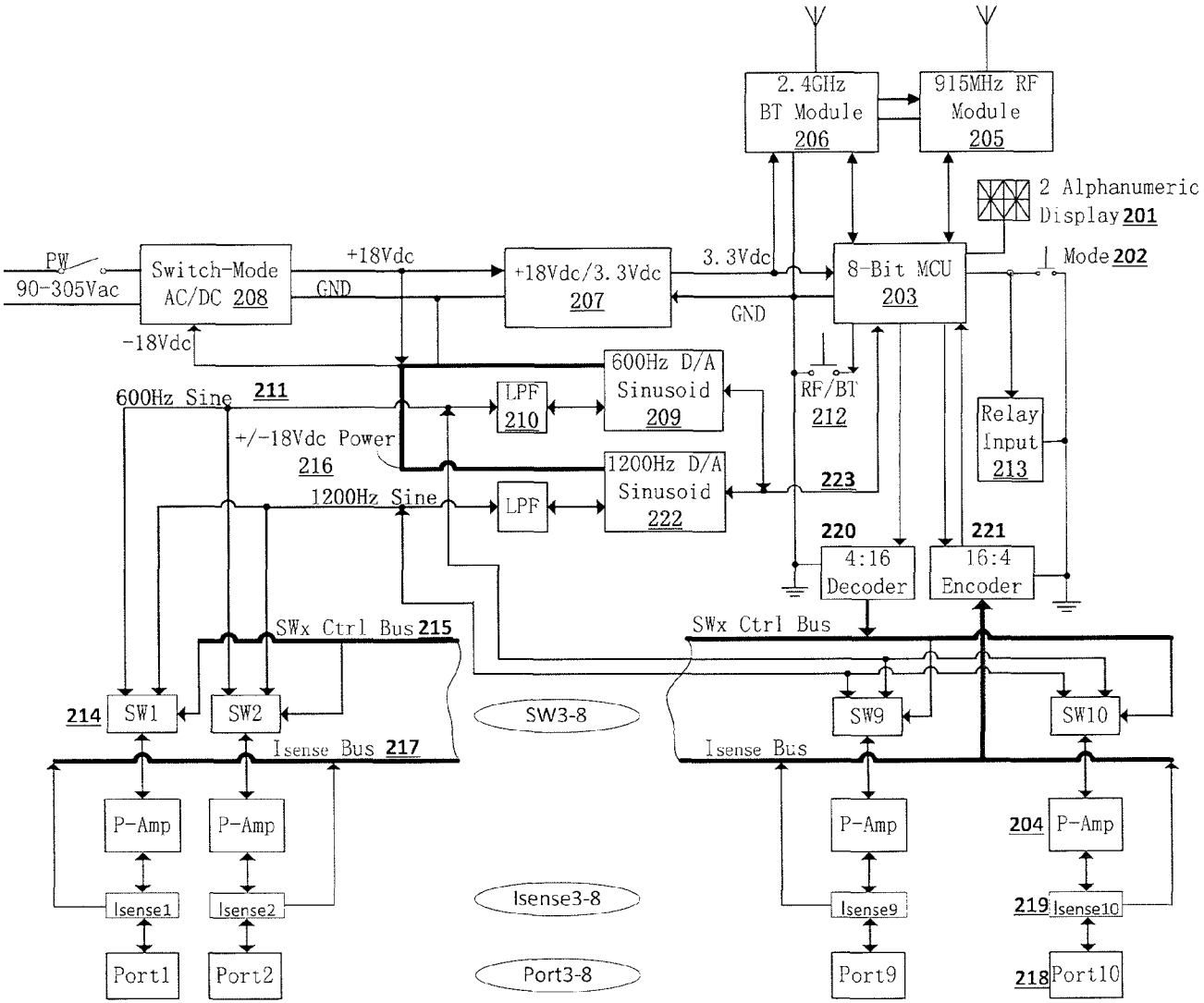
FIG. 2 is a block diagram of the central controller in terms of electronic functionality.

FIG. 2 shows a block diagram of central controller 103. In FIG. 2, through a switch-mode power converter 208, the worldwide universal commercial AC voltage rated from 90 through 305 Vac is converted at +/−18 Vdc to provide the negative and the positive peak voltages required by an AC (Alternating Current) power source at 12 Vrms (Root Mean Square). A DC (Direct Current) converter 207 is to convert 18 Vdc to 3.3 Vdc to power all digital circuits and some analog circuits, such as Bluetooth module 206 and RF module 205, logic components 220 and 221, and an 8-bit MCU (Micro Control Unit) 203. Two D/A (Digital to Analog) converters 209 and 222 generate two sinusoid waveforms at 600 Hz and 1200 Hz, separately. Two LPF (Low Pass Filter) 210 filters out all high frequency harmonics coming from two A/D outputs. Two synchronized sinusoid waveforms reach 10 digital switches 214 in name from SW1 through SW10. At default, meaning that no control signals are on the power line, all SWx 214 switches are set to select 600 Hz sinusoid waveform to pass to D-class power amplifier P-Amp 204 to escalating the driving capability up to 8 W at all 10 ports 218. For the power source path, IsenseX 219 can be taken as shorted due to its very small resistance.

Figure 9:
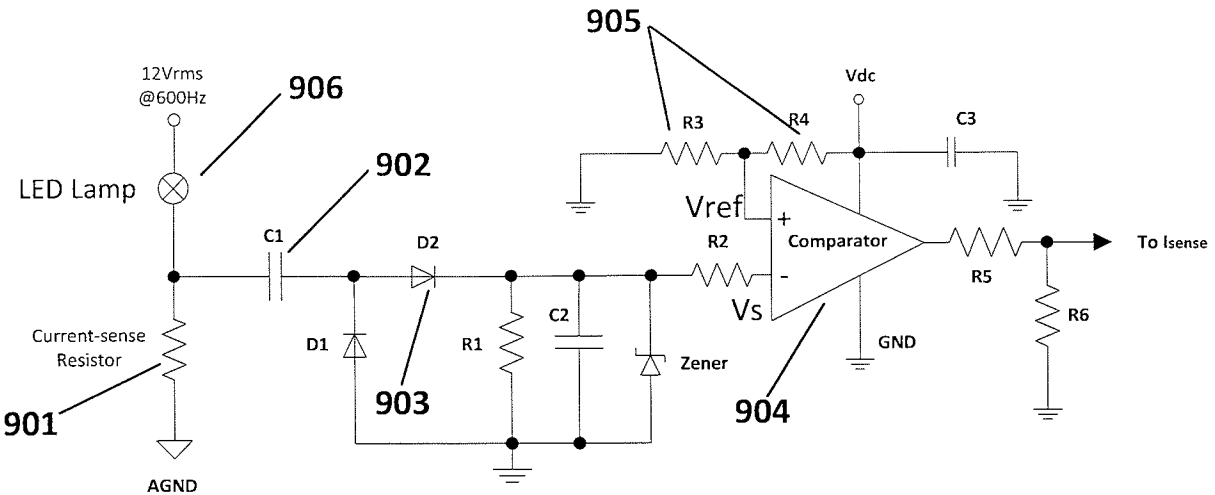
FIG. 9 is a block diagram of circuitry attached to a lamp in accordance with one aspect of the invention.

The color LED chip, usually having 3 different diodes, red, green, and blue, is different from the white LED having only one diode. In order to enable the central controller 103 to determine whether a particular port is configured with a white or a color LED lamp, The IsenseX 219 (where the X refers to a numbered lamp, shown in FIG. 2 as Isense1, Isense2, etc.) as shown in FIG. 9, a current-sensing circuit, is added to measure the load current from the connected LED lamp on each specific port. On the lamp side, the white lamp sets 10% PWM duty cycle and the color lamp sets 50%, after the lamp receives the type identification command. The type identification process is triggered by press-and-hold two pushbuttons 201 and 212 for 6 seconds. The central controller 103 sends the type identification command to all 10 ports one by one.

Turning now to FIG. 9, if a white lamp 906 is connected, the MCU on the lamp will adjust its PWM to 10% to enable the load current-sensing circuit to obtain lower voltage across a current-sense resistor 901; while a color lamp will generate higher voltage through a coupling capacitor 902 and a diode 903 to convert 12 VSRM into a DC sampling voltage. Then, a comparator 904 compares this sampling voltage "Vs" to the preset reference voltage "Vref" which is determined by a voltage divider composed of two resistors 905. If Vs is higher than Vref, the comparator outputs logic low voltage "0" to Isense bus 217, representing that a white LED lamp has been detected. Otherwise, a logic high voltage "1" is output to the Isense bus 217, identifying a color LED.

Figure 4:
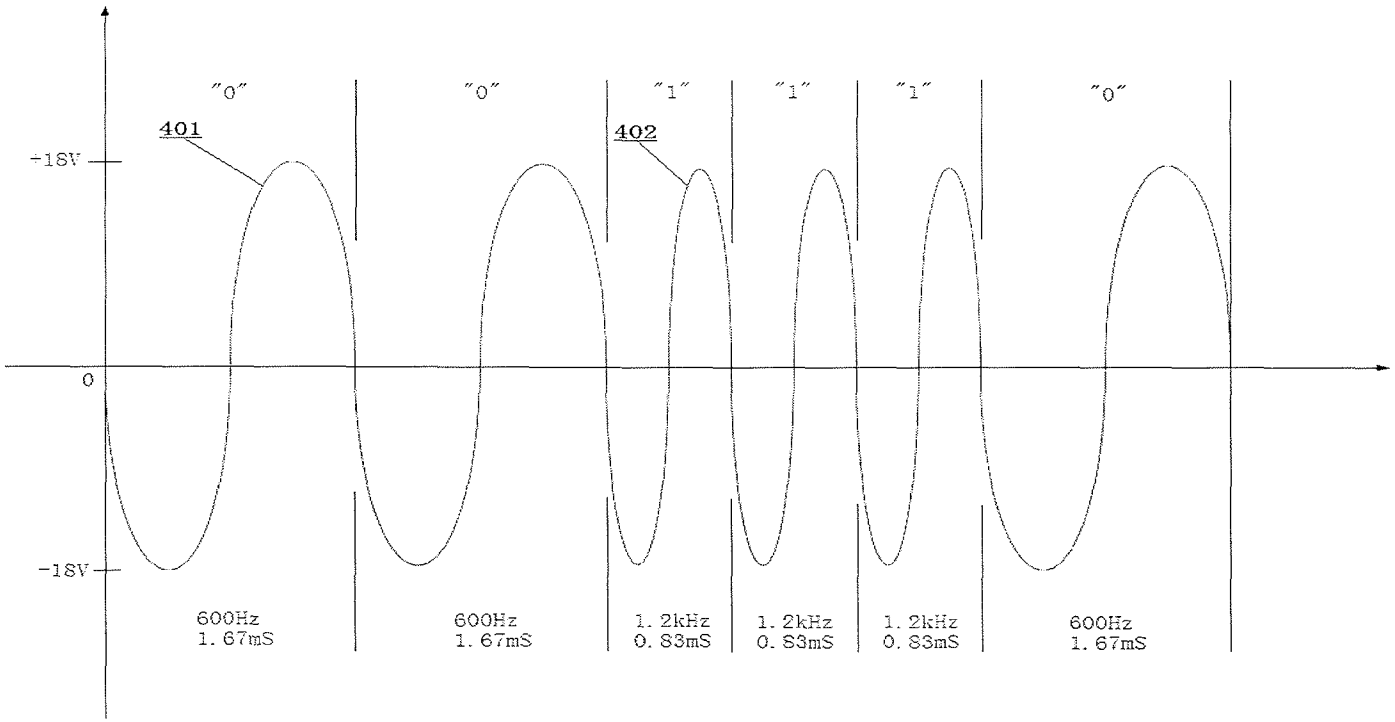
FIG. 4 illustrates the binary "0" and "1" interpretation with F/2F modulation technique.

Turning back to FIG. 2, MCU 203 controls the encoders 221 to capture the logic voltage on each port until all 10-port configured status has been identified. Each port identifying process takes 12 cycles under the condition of the 600 Hz power source. Hereafter, MCU 203 knows where the color lighting control signals should go and where the white control signal should go. This is the way the PnP is implemented, meaning that the LED lamp in either the color or the white can be readily connected to any ports with no setup need. The default power source powering the lamps over the 2-wire power cord is 12 Vrms in 600 Hz sinusoid waveform. When a control signal is to be transmitted from the central controller 103, MCU 203 modulates the control signal with 600 Hz and 1200 Hz for the binary bit "0" or "1" in sequence as shown in FIG. 4, which is usually called "F/2F modulation". The one period of sinusoid waveform 401 represents bit '0' and 402 stands for bit '1' with the transition at the phase zero. When a bit '1' is to be transmitted, MCU 203 selects SWx 214 by its output port 223 to toggle 600 Hz to 1200 Hz sinusoid for one complete period. If the next bit is bit '0', it is toggled back to 600 Hz for one period, but if another bit '1', it remains at 1200 Hz for another period, and so on, so forth, till all bits of the packet have been sent out, then return SWx 214 to the default 600 Hz position.

Four different lighting control units are available, a wireless computing device 102 such as a smartphone, an RF remote 101, panel buttons 202 and 212, and a dry contact 213 on an external relay. The alphanumeric LED display panel 201 displays interactive information for human interfacing operation like Bluetooth and RF remote pairing, type identification triggering, etc. Two wireless modules 205 or 206 will receive the lighting control signals from either the RF remote 101 or the smart phone 102. MCU 203 will send all color lighting control signals to all configured color LED lamps and delivers the white lighting control signals to all connected white LED lamps, based on its port status recorded in memory (not shown) such as EEPROM after executing the type identification operation. The MCU 203 selects the appropriate port through an encoder 221 and SWx control bus 215 for the lighting control signal transfer. Whenever a lighting control command is to be transfer to the lamp through a specific Port 218, through a decoder 220, The MCU is able to select the relevant Switch 214 to toggle the output bitwise sinusoid wave frequency from two frequency sources, 600 Hz and 1200 Hz. Every bit is modulated in this way. One byte is composed of 8 bits, and a lighting control command is usually a few bytes long. All 10 switches 214 are set with 600 Hz sinusoid waveform output while no commands are being transmitted to the relevant port 218, ready to be converted to 1200 Hz when needed.

The Bluetooth module 206 functions to transfer the lighting control signals from a smart phone 102 to the central controller 103 and receive a confirmation message to acknowledge the control signal received by the phone 102. In order to communicate with the central controller 103, application software (an "App") must be downloaded from a specific server and installed on the phone 102.

Figure 7:
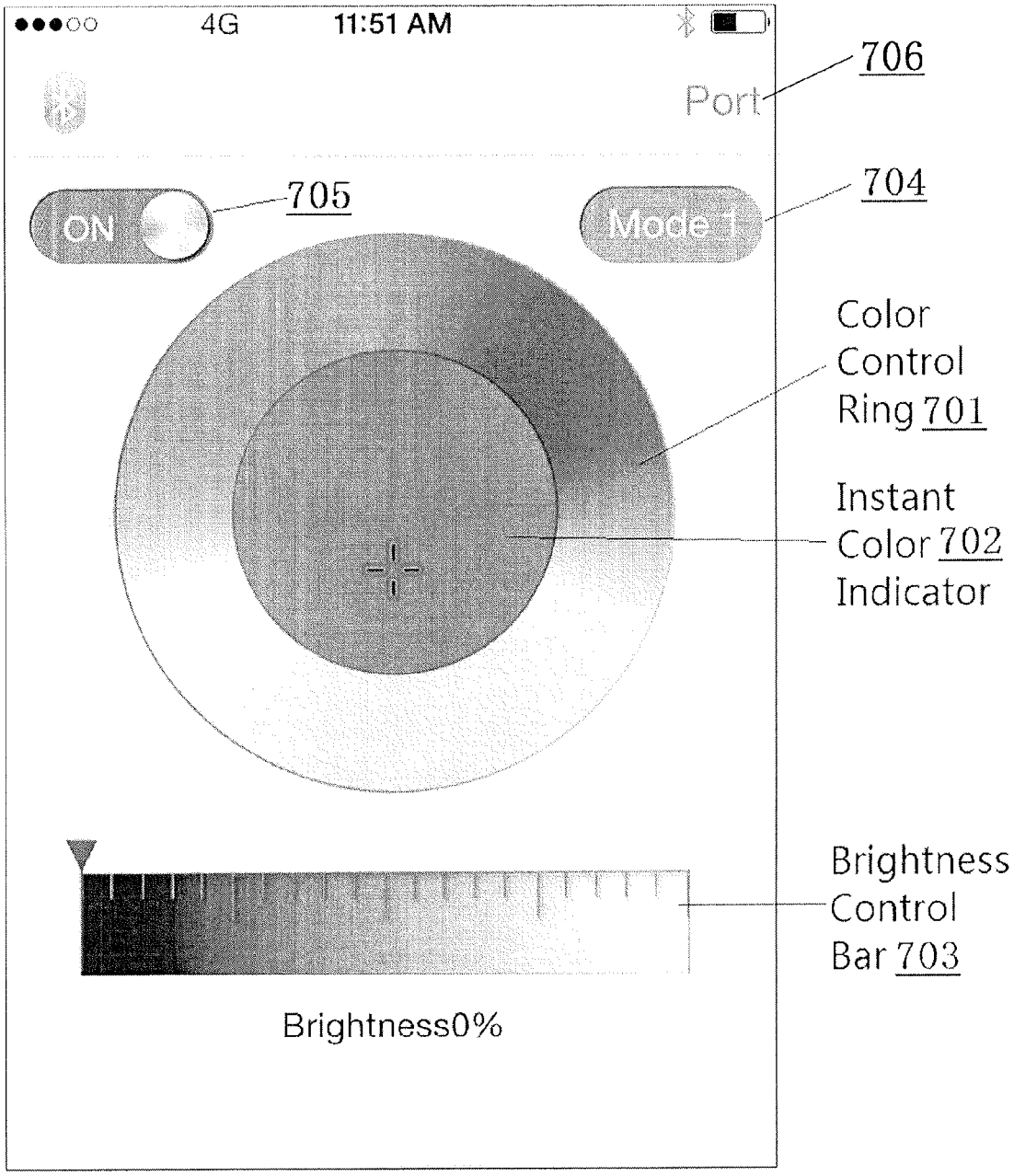
FIG. 7 is a GUI of the lighting control on the smart phone.

After launching the App, the control GUI is displayed as shown in FIG. 7. Icon 705 is the power switching button; 704 is the display mode increment button; 703 is the brightness adjustment bar, allowing for adjustment of brightness on a sliding scale. Color selection ring 701 is, in one aspect, a color gradient allowing the user to choose a color from an RGB lamp. Instant color indicator 702 displays the current color, and also acts as a white selection button. Touching any color point on the color ring 701 will instantly change the LED lamp color and the instant color will be displayed on 702. But if 702 is touched, the lamp will be changed to the white. Every time 704 is touched, the display mode will cycle from 1 to 8, and then recycle from mode 1. The brightness bar 703 can be continuous adjusted. The cursor above the bar 703 will move and stay at the current brightness scale and the brightness percentage number will be shown beneath the bar 703.

Figure 6:
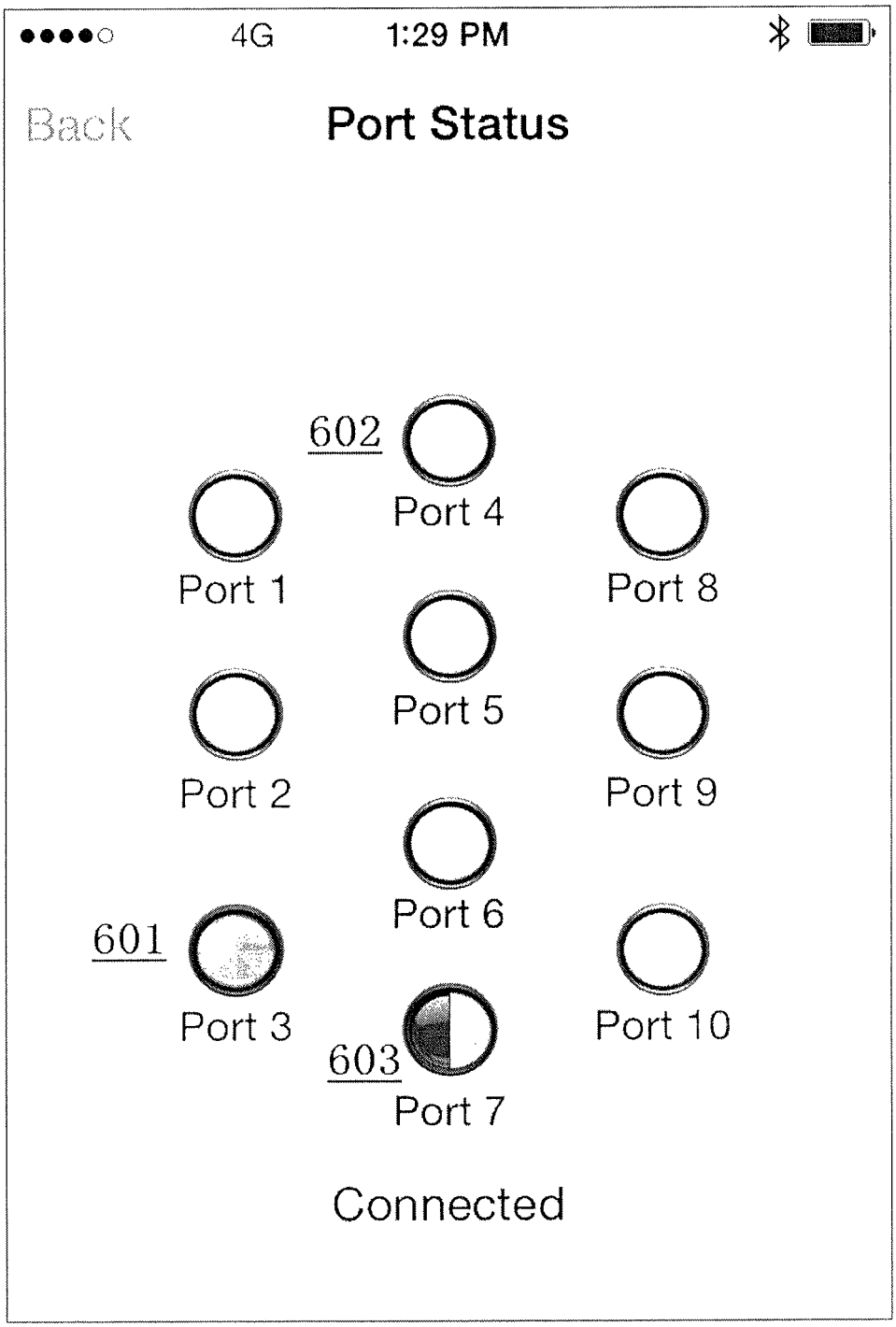
FIG. 6 is a GUI of the central controller's port status on a smart phone.

When "Port" 706 is touched, the GUI will be switched to the port status GUI, an example of which is shown in FIG. 6, in which indicator 602 shows that Port 4 has no lamps associated. Indicator 601 shows that Port 3 has a color lamp connected, and gives different color selection options. Indicator 603 shows Port 7 has a white lamp connected, and gives white/dark options. The port status data is transmitted from the central controller 103 to the smart phone 102 through Bluetooth right after central controller 103 finishes the type identification. The smart phone must be paired to the specific central controller 103 before use to reduce or eliminate interference from other smart phones in the valid Bluetooth range.

Figure 8:
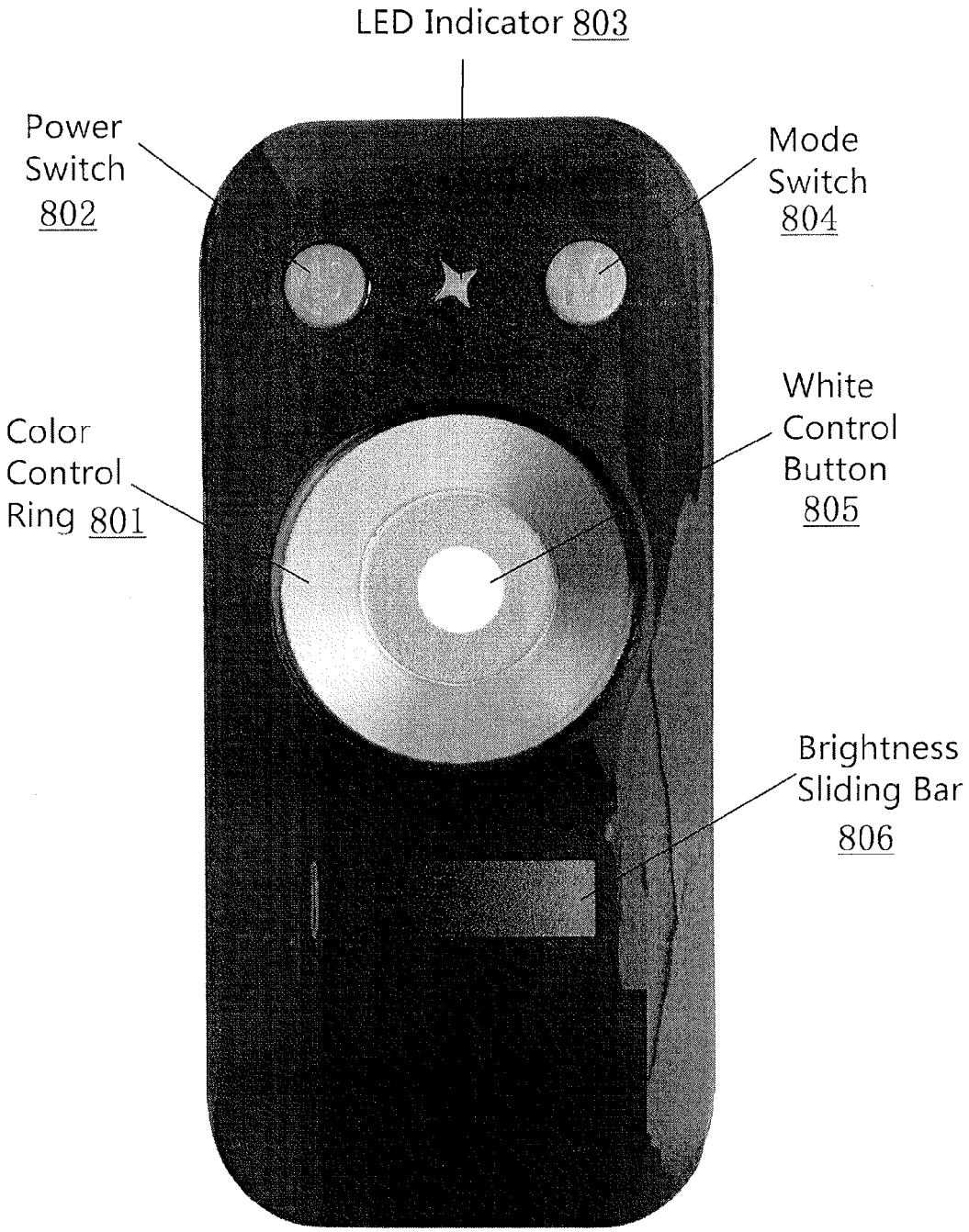
FIG. 8 is the surface of the RF remote controller.

The RF remote shown in FIG. 8 has the color ring 801, the power switching button 802, brightness adjustment bar 806, and the display mode increment button 804 in almost same construction as the smart phone control GUI in FIG. 7 but no instant color indicator. Touching central white solid circle 805 will send the white color control signal to all lights. The brightness adjustment bar 806, different from the smart phone GUI, is sliding-type. Once a ringer sliding from the left to the right side on the bar will increase 25% brightness to the current brightness level; while from the right to the left will decrease 25% brightness from the current. A white LED indicator 803 on the top will flash when a control signal is being successfully transmitted to the central controller. When the control signal is send to the central controller either from the remote or the smart phone, the LED display panel 201 will update the display of the mode number and the brightness level instantly. The RF remote must be paired to the specific central controller prior to use in order to prevent any interference from the other RF remote operation within the effective RF range.

Figure 3:
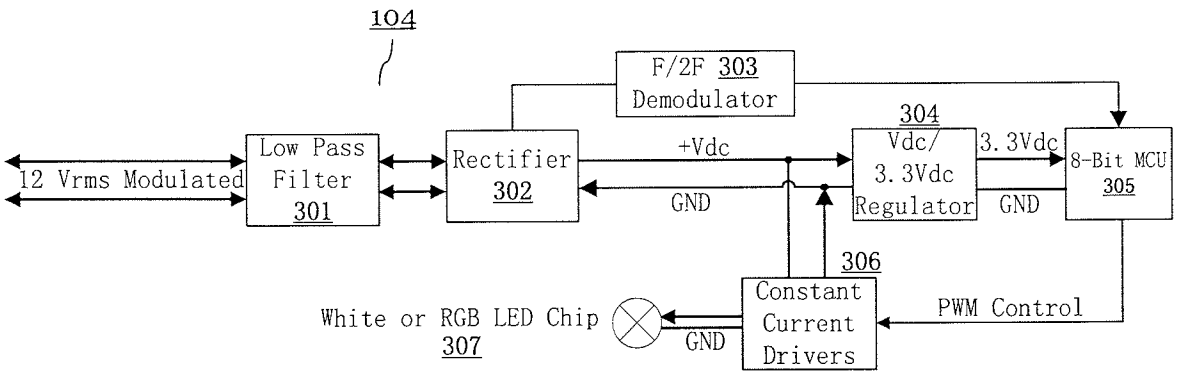
FIG. 3 is a block diagram of the special LED lamp.

FIG. 3 demonstrates the block diagram of a LED lamp 104 as described earlier with reference to FIG. 1. 12 Vrms AC power goes through a low pass filter 301 and a full bridge rectifier 302 to obtain 12 Vdc. A DC converter 304 provides 3.3 Vdc to MCU 305 inside the lamp and a constant current LED driver 306 is employed to drive LED chip 307, if LED chip 307 is white, as illustrated in FIG. 3. However, for the color lamp, where LED chip 307 is an RGB LED chip, 3 of constant-current driver 306 are needed. A demodulator 303 modulates "0" and "1" for the control signals by measuring the timing of the sinusoid period and send to MCU 305. The MCU changes the white LED brightness by adjusting the PWM (Pulse Width Modulation) duty cycle output to driver 306, and mixes the lighting color by proportionally adjusting 3 PWM duty cycles on the 3 output ports. Considering most of existing pool LED lamps work with a conventional 12 Vac power source directly from a 12 Vac transformer, every time the lamp powers up, MCU 305 will detect the frequency of the power source on the power line. If the frequency is 50 or 60 Hz from a regular commercial AC electricity source, the lamp will disable demodulation function to enable the lamp compatible with the transformer driving. It the frequency is higher than 60 Hz, the modulation function is enabled.

Figure 5:
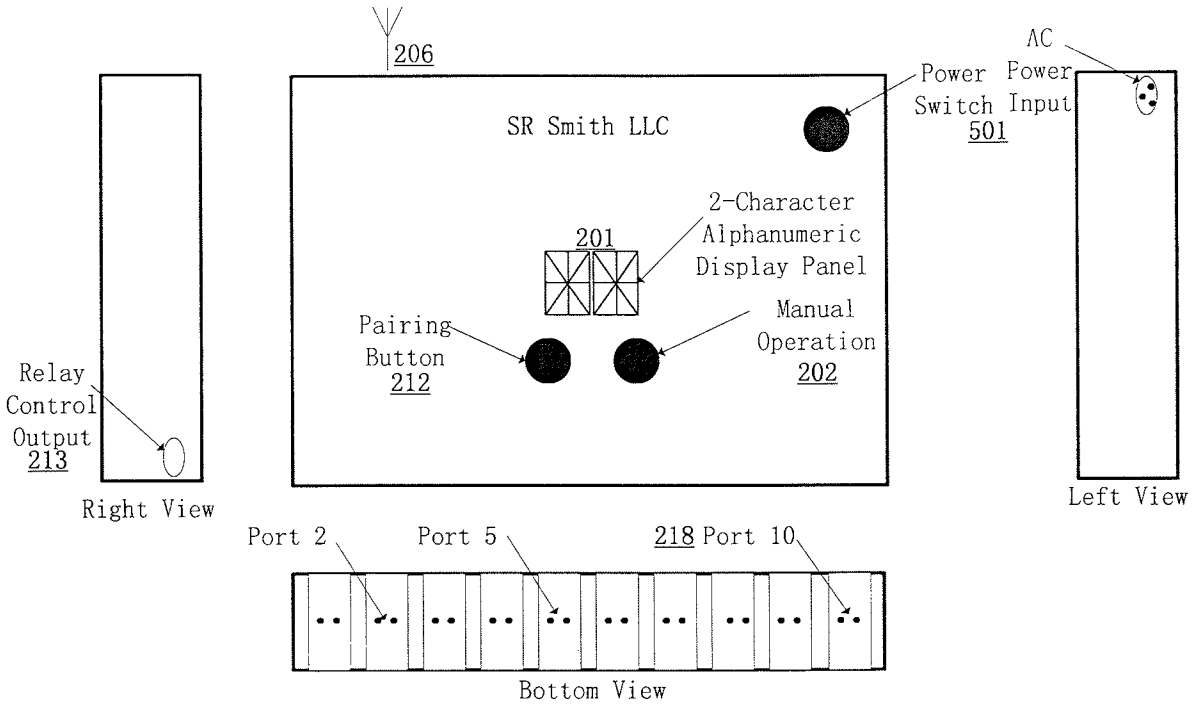
FIG. 5 indicates the construction of the panel and the connection ports on the central controller.

FIG. 5 shows the central controller structure. The controller's box is made by plastic material and installed outdoors and waterproofed. The 10 LED connection ports 218 are located at the bottom of the box. 915 MHz antenna (not shown) uses a PCB copper-etched antenna placed inside the box, so only one 2.4 GHz Bluetooth antenna 206 is mounted on the top fame of the box. A commercial AC electricity power cord is input from the port 501 on the right top side and the relay dry-contact input 213 is on the left bottom side.

Referring to FIG. 5, there are two buttons on the central controller's panel. The left button 201 is to pair Bluetooth and RF remote plus the brightness adjustment; the right button 202 to increment the display mode. Total 8 different display modes are pre-stored on the lamp's MCU. Every time the right button is pressed, the mode is incremented. When it reaches 8, one more button pressing will recycle the mode number to mode 1. An external relay control 213 (dry contact) is available for any other swimming pool lighting control devices to control the display mode through a regular relay, functioning like the right button 202 operation.

All lighting control signals abide by the communication protocol format defined as the following example.

The first byte, a start byte "0x5F", is to notify the lamp of a control signal coming.

All control signal packets here described have the same format. One byte of the start byte "0x5F" must be transmitted first but excluding on each packet. The following byte is command byte and the last part is the data bytes which could be zero or more than one byte. Bit7 on the command byte is reserved for stop bit and is always set at "1", and Bit6 is an odd parity bit. Every byte is transferred from MSB (Most Significant Bit) first.

The brightness is defined at 16-level greyscale (4-bit representation) applying to both the white and the color lamp. The color lamp has 4 k color-mix with 4-bit length for the red, the green, and the blue, separately, totaling 12-bit color.

Timing data has 4-bit length. 0x0 is instantaneous on; 0x1=0.5 second interval; 0x2=second, . . . , 0xE=7 seconds, and 0xF is continuous-on till asked to change. If the timing interval needs more than 7 seconds, the control box has to send this packet to the lamp before the last 7-second runs out for the timing extension.

A command byte includes 2-bit Start Sentinel (SS) '0B11' at Bit0 and Bit1, 4-bit payload at "0BXXXX" Bit2 through Bit5, 1-bit odd Parity '0BX' at Bit6, and 1-bit Stop '0B1' (MSB). Here B stands for a binary number and "X" for "0" or "1". The odd parity includes all bits except the stop bit. The following is the list of some packet examples.

1. The color-mix packet has 3 bytes length excluding the start byte (all the same in the following example). The command is 0x1B and two data bytes have one and a half bytes for RGB (Red, Green, Blue) data and the 4-bit brightness data is also included.

| | Bit7 | Bit6 | Bit5 | Bit4 | Bit3 | Bit2 | Bit1 | Bit0 |
|---|---|---|---|---|---|---|---|---|
| 1st Byte | 1 | 0 | 0 | 1 | 1 | 0 | 1 | 1 |
| 2nd Byte | G-Bit3 | G-Bit2 | G-Bit1 | G-Bit0 | R-Bit3 | R-Bit2 | R-Bit1 | R-Bit0 |
| 3rd Byte | T-Bit3 | T-Bit2 | T-Bit1 | T-Bit0 | B-Bit3 | B-Bit2 | B-Bit1 | B-Bit0 |

In brief, R-Bit0 stands for Red Bit0, G-Bit0 for Green Bit0, B-Bit0 for Blue Bit0, and T-Bit0 for Timing Bit0.

This packet is only sent to the color lamp.

2. The brightness packet has 2-byte length. The command is 0x17. In brief, Br-Bit0 is for brightness Bit0. The data is one byte including 4-bit timing and 4-bit brightness together.

| | Bit7 | Bit6 | Bit5 | Bit4 | Bit3 | Bit2 | Bit1 | Bit0 |
|---|---|---|---|---|---|---|---|---|
| 1st Byte | 1 | 0 | 0 | 1 | 0 | 1 | 1 | 1 |
| 2nd Byte | T-Bit3 | T-Bit2 | T-Bit1 | T-Bit0 | Br-Bit3 | Br-Bit2 | Br-Bit1 | Br-Bit0 |

This brightness packet applies to both the white and the color lamp. The zero brightness is similar to power-off of the lamp and 0xF is the full scale brightness.

3. Display mode increment packet has 1 byte length with no data bytes. The command is 0x83.

| | Bit7 | Bit6 | Bit5 | Bit4 | Bit3 | Bit2 | Bit1 | Bit0 |
|---|---|---|---|---|---|---|---|---|
| First Byte | 1 | 0 | 0 | 0 | 0 | 0 | 1 | 1 |

The predefined 8 different modes are listed as Soft Color Change, White, Blue, Green, Red or Aqua, Amber, Magenta, and Flash Color change. These modes are only stored in the MCU inside the color lamp. The 12 Vac transformer is to increment the mode by power toggle the power switch once. But for the central controller, the mode is incremented by executing this command.

Mode 1: Soft Color Change—cycle starting from red, amber, green, blue, magenta, and white endlessly till asked to change.

Mode 2: Static white on.

Mode 3: Static blue on.

Mode 4: Static green on.

Mode 5: Static red on.

Mode 6: Static amber on.

Mode 7: Static magenta on.

Mode 8: Disco—the lamp flashes from red, amber, green, blue, magenta, and white in sequence at 0.5 second interval and cycle endlessly.

This command is to ask the color lamp to increment the mode number from the current mode every time it is received. After Mode 8 is reached, it starts over from Mode 1 again.

4. Port status inquiry packet has 1 byte length. The command is 0xDB with no data bytes.

| | Bit7 | Bit6 | Bit5 | Bit4 | Bit3 | Bit2 | Bit1 | Bit0 |
|---|---|---|---|---|---|---|---|---|
| First Byte | 1 | 0 | 0 | 1 | 1 | 0 | 1 | 1 |

This command is to let MCU 203 identify all port configured status, so that the updated port status can be displayed on the smart phone's GUI and the MCU is able to send the appropriate lighting control signals to the right port.

The above demonstrate some control signals for example descriptions, but not cover all commands.

The examples noted here are for illustrative purposes only and may be extended to other implementation embodiments. While several embodiments are described, there is no intent to limit the disclosure to the embodiment(s) disclosed herein. On the contrary, the intent is to cover all alternatives, modifications, and equivalents obvious to those familiar with the art.

What is claimed is:

1. A system for controlling a swimming pool lamp, comprising:

a. a central controller having:

i. a waveform converter modulating and sending, via serial transmission, power and a control signal at more than one frequency over a two wire power cable, said control signal modifying a property of the lamp; and ii. a load current sensor identifying a configuration of the lamp; and b. a lighting control unit coupled to the lamp, said lighting control unit being powered via the two wire power cable, said lighting control unit demodulating the control signal.

2. The system of claim 1, wherein said central controller further comprises a radio frequency communication module.

3. The system of claim 2, further comprising an electronic computing device containing computer readable code in communication with the central controller via the radio frequency communication module.

4. The system of claim 3, wherein the radio frequency communication module is a Bluetooth communication module.

5. The system of claim 3, wherein said central controller is converting information from the load current sensor into lighting configuration data, and wherein the electronic computing device is receiving the lighting configuration data from the central controller and displaying said lighting configuration data via a graphical user interface.

6. The system of claim 3, said computer readable code displaying a progressive bar indicating a spectrum of brightness options, and transmitting a brightness selection to the central controller.

7. The system of claim 2, further comprising a radio frequency remote control communication with the central controller via the radio frequency communications module.

8. The system of claim 1, wherein said property is brightness of the lamp.

9. The system of claim 7 wherein the control signal is setting four levels of brightness.

10. The system of claim 1, wherein the property is a color of light emitted from the lamp.

11. The system of claim 1, wherein said lighting control unit is transmitting power to the central controller at different load-current levels to identify the configuration of the lamp.

12. The system of claim 1, wherein the configuration relates to whether the lamp is single color or multi color.

13. A system for controlling a swimming pool lamp, comprising:

a. a central controller having:

i. a waveform converter modulating and sending, via serial transmission, power and a control signal over a two wire power cable, said control signal modifying a property of the lamp; and ii. a load current sensor identifying a configuration of the lamp; and b. a lighting control unit coupled to the lamp, said lighting control unit being powered via the two wire power cable, said lighting control unit demodulating the control signal.

14. The system of claim 13, wherein said modulating said control signal comprises varying the amplitude of waveform transmissions.

15. The system of claim 13, wherein said modulating said control signal comprises varying the frequency of waveform transmissions.

* * * * *